US008176990B2

(12) United States Patent
Beller et al.

(10) Patent No.: US 8,176,990 B2
(45) Date of Patent: May 15, 2012

(54) APPARATUS FOR REMOVING OBSTRUCTIONS FROM A WORKSITE

(75) Inventors: Larry D. Beller, Madill, OK (US); Ronald L. Major, Noble, OK (US)

(73) Assignee: Construction Technology, Inc., Noble, OK (US)

( * ) Notice: Subject to any disclaimer, the term of this patent is extended or adjusted under 35 U.S.C. 154(b) by 208 days.

(21) Appl. No.: 12/113,542

(22) Filed: May 1, 2008

(65) Prior Publication Data

US 2008/0264658 A1 Oct. 30, 2008

Related U.S. Application Data

(63) Continuation-in-part of application No. 11/465,737, filed on Aug. 18, 2006, now Pat. No. 7,472,869, which is a continuation of application No. 10/717,114, filed on Nov. 19, 2003, now Pat. No. 7,104,510.

(60) Provisional application No. 60/427,915, filed on Nov. 20, 2002.

(51) Int. Cl.
*A01B 33/00* (2006.01)

(52) U.S. Cl. ..... 172/45; 56/294

(58) Field of Classification Search ..... 56/249, 56/294, 504, 252, 156, 295, 249.5–254; 172/112, 172/47, 30, 123, 125, 518, 122, 45, 810–816; 144/208.7, 341; 89/1.33, 1.13
See application file for complete search history.

(56) References Cited

U.S. PATENT DOCUMENTS

| | | | | |
|---|---|---|---|---|
| 3,271,939 | A * | 9/1966 | Granger, Jr. et al. | 56/10.5 |
| 3,754,603 | A * | 8/1973 | Bogie | 172/45 |
| 4,041,996 | A * | 8/1977 | Grover | 144/24.12 |
| 4,899,522 | A * | 2/1990 | Munger | 56/10.4 |
| 5,003,759 | A * | 4/1991 | Brown | 56/249 |
| 5,666,794 | A * | 9/1997 | Vought et al. | 56/15.2 |
| 6,148,926 | A * | 11/2000 | Manor et al. | 172/45 |
| 6,560,905 | B2 * | 5/2003 | Monroe | 37/248 |
| 6,772,578 | B2 * | 8/2004 | Schrattenecker | 56/220 |
| 6,871,485 | B2 * | 3/2005 | Schafer | 56/249 |
| 7,096,900 | B2 * | 8/2006 | Schafer | 144/4.1 |

* cited by examiner

*Primary Examiner* — Robert Pezzuto
(74) *Attorney, Agent, or Firm* — Tomlinson Rust McKinstry Grable

(57) ABSTRACT

A device for removing obstructions from a work site. The device is attachable to the front of a work machine. The device comprises a frame, a flange, a rotatable cutting member supported on the flange, and a motor that rotates the cutting member. The flange is non-rotatable, but is movable along at least one length relative to the frame. The motor may be supported on the flange. The device further comprises a plurality of removably attachable blocking members for decreasing the range of travel of debris generated during operation of the cutting member. The rotatable cutting member is movable about three axes relative to the flange such that changes in conditions or temperatures do not cause the cutting member to break.

26 Claims, 11 Drawing Sheets

APPARATUS FOR REMOVING OBSTRUCTIONS FROM A WORKSITE

CROSS-REFERENCE TO RELATED APPLICATIONS

This application is a continuation-in-part of U.S. patent application Ser. No. 11/465,737 filed on Aug. 18, 2006, entitled BALANCING ASSEMBLY FOR ROTATING CYLINDRICAL STRUCTURES, which was a continuation of U.S. patent application Ser. No. 10/717,114 filed on Nov. 19, 2003 entitled BALANCING ASSEMBLY FOR ROTATING CYLINDRICAL STRUCTURES, now U.S. Pat. No. 7,104,510 which claims priority from U.S. Provisional Patent Application Ser. No. 60/427,915 filed on Nov. 20, 2002 entitled BALANCING ASSEMBLY FOR ROTATING CYLINDRICAL STRUCTURES.

REFERENCE TO MICROFICHE APPENDIX

This application is not referenced in any microfiche appendix.

BACKGROUND OF THE INVENTION

1. Field of the Invention

The present invention relates to balancing assemblies for rotating members for use in removing obstructions from a work site. More particularly, the invention relates to self-aligning balancing assemblies for large cylindrical cutting members supported on a work vehicle.

2. Background

Industry is replete with many examples of large cylindrical drums that must be rotated for various reasons. For example, factories in the paper industry must employ large heavy drum assemblies for receiving and storing rolls of kraft paper. The road construction industry uses road machines having large drums with cutting blades embedded on the drum surface for abrading rock during road construction.

These cylindrical drum assemblies are generally massive and require a high torque motor or engine to initiate rotation of the drum and to maintain rotation during operation. Although the drum assemblies are rotated at a low number of revolutions per minute (rpm), the high mass of the drum results in several problems. First, the centrifugal force produced by the rotation of a high mass structure is extreme even at low rpm and necessitates a robust, heavy duty gear box to transmit the rotational force of the motor to the drum. Often, a separate gear box and motor assembly is used on each of the opposing ends of the axis about which the drum rotates. In such a configuration, one gear box and motor assembly is structured for clockwise rotation and the opposing gear box and motor assembly is structured for counter-clockwise rotation so that their rotational force combines to rotate the drum in a single direction. These gear box and motor assemblies distribute the force required to rotate the drum so that less robust gear boxes and motors may be used.

Second, if the drum is unbalanced around the axis of rotation so as to produce an oscillating radial force, this radial force will excessively wear the gear box and motor so as to cause premature failure. When using a pair of opposing gear box and motor assemblies, the alignment of the centerline of both assemblies reduces radial forces and resultant wear on the bearings of these assemblies; otherwise the misalignment will cause premature failure of the bearings. This alignment may be achieved by precise machining and balancing of the drum. However, such machining and balancing for drums with diameters in excess of 12 inches and lengths in excess of five feet requires large, heavy duty, and expensive machines to turn the massive drums and cut away excess metal. High precision is difficult to attain when dealing with such heavy, bulky structures. Additionally, the removal, shipping, and replacement of the drum in its installed location is expensive in terms of required man power. The removal, shipping, and replacement can also be further complicated by the fact that machines employing such heavy drums, e.g. road equipment, are often used in remote locations where transportation is difficult and knowledgeable maintenance personnel are unavailable.

Third, during use, the drum is loaded by the work against which it rotates, e.g. the road surface for a cutting drum or the uneven winding of paper on a takeup drum in a paper plant. This loading coupled with the massiveness of the drum causes a small amount of deflection which also results in unbalancing of the drum assembly.

Fourth, even if the drum is perfectly balanced about its axis of rotation, the gear box must be positioned precisely so that the shaft is exactly colinear with the axis of rotation. This requires that the mounting surfaces for the gear box must be machined to very precise tolerances. On a large machine, this is very difficult and expensive, and, while it improves the initial misalignment, it does not help with the deflection problem.

As can be seen, there is a need for a method and apparatus to maintain the balance of a massive rotating drum assembly, reduce the requirement for close precision in the physical balancing process for the drum, and dynamically adjust for in-use deflection of the drum so that balance about the axis of rotation is maintained.

SUMMARY OF THE INVENTION

One aspect of the present invention is directed to a device for removing obstructions from a worksite. The device comprises a frame, a flange, a first motive force means, and a rotatable cutting member. The flange is supported on the frame and moveable about three axes. The first motive force means is supported by the flange. The cutting member is operatively connected to the motive force means such that the motive force means is disposed within the rotatable cutting member.

In another aspect of the invention, the device for removing obstructions from a work site comprises a frame, a rotatable cutting drum, a means for rotating the cutting drum, and a means for aligning a centerline of the rotatable cutting drum. The means for rotating the drum is supported by the frame. The means for aligning a centerline of the rotatable cutting drum is supported by the means for rotating the rotatable cutting drum and allows movement of the cutting drum along at least one length.

Yet another aspect of the invention is directed to a work machine. The work machine comprises a drive frame, a means for translating the drive frame, and a device for removing obstructions from a worksite supported by the drive frame. The device comprises a frame, a flange, a first motive force means, and a rotatable cutting member. The flange is supported on the frame and moveable about three axes. The first motive force means is supported by the flange. The rotatable cutting member is operatively connected to the first motive force means such that the first motive force means is disposed within the rotatable cutting member.

DETAILED DESCRIPTION OF THE INVENTION

The following detailed description shows the best currently contemplated modes of carrying out the invention. The description is not to be taken in a limiting sense, but is made for the purpose of illustrating the general principles of the invention and the best mode for practicing the invention, since the scope of the invention is best defined by the appended claims. The invention is capable of other embodiments and of being practiced or carried out in a variety of ways. It is to be understood that the phraseology and terminology employed herein are for the purpose of description and not of limitation.

Figure 1:
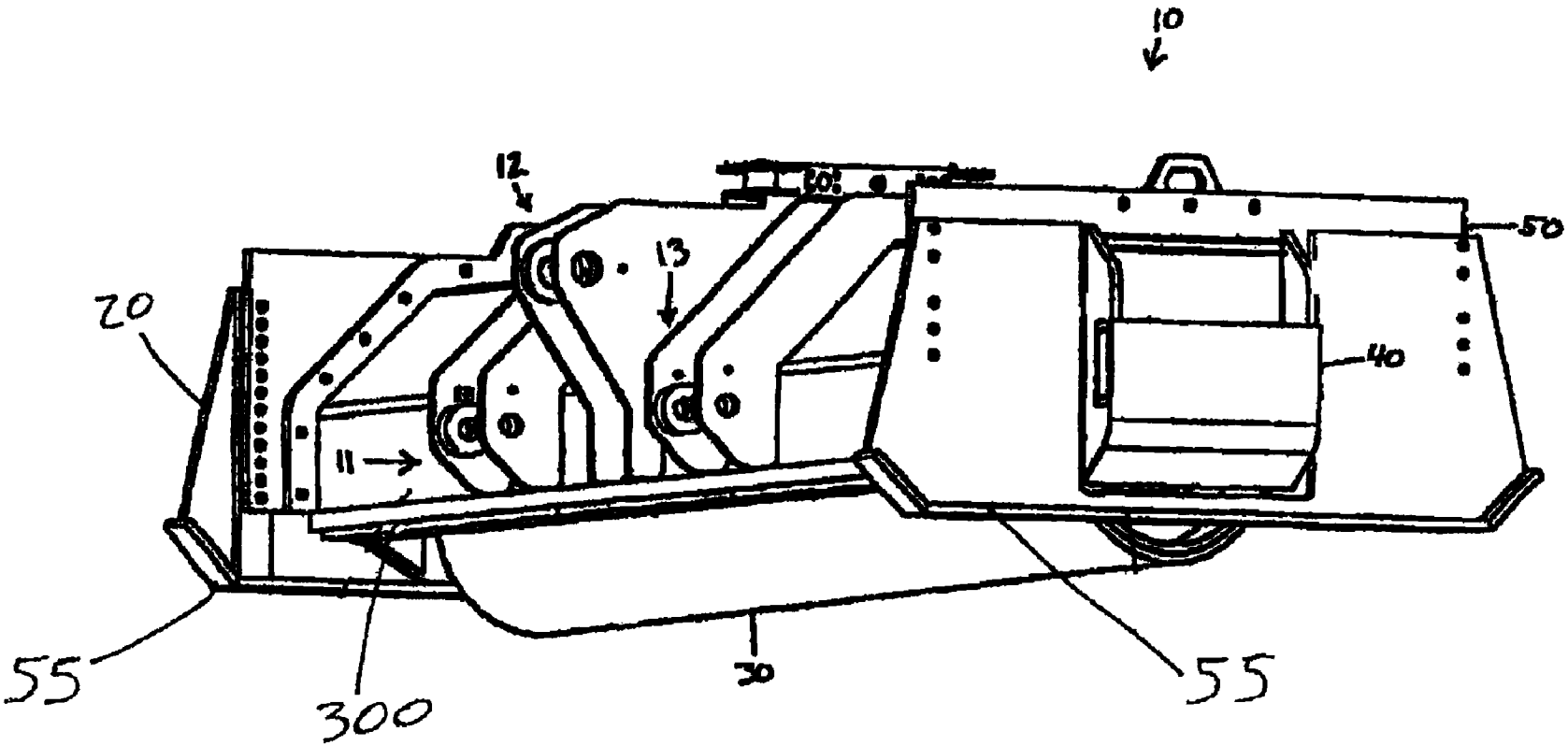
FIG. 1 is a perspective view of a device for removing obstructions from a worksite comprising a rotating cutting member and motive force means axially positioned at either or both ends of the cutting member.
Figure 10:
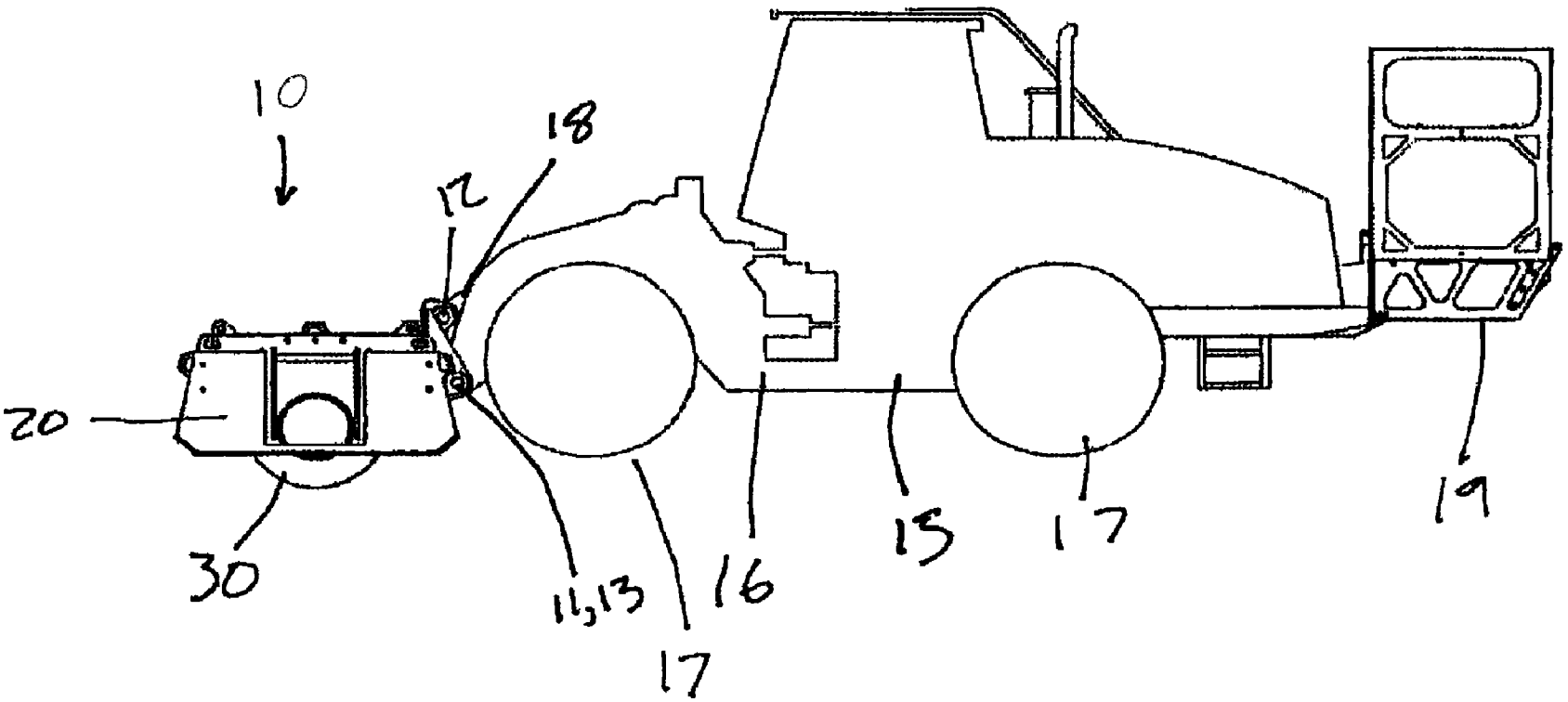
FIG. 10 is a side view of a work machine adapted for use with the present invention.

Referring to FIG. 1, a device 10 for removing obstructions from a worksite is shown. The device 10 is used for grinding rock and hard earth for the preparation of road beds and for removing obstructions, such as brush and trees, from a worksite. With reference to FIG. 10, the device is configured for mounting on a tractor or other work machine 15, the tractor comprising a drive frame, also referred to as undercarriage, 16, a means for translating the undercarriage 17, and an arm 18 connecting to the device 10 at the connection points 11, 12, and 13 (FIG. 1). In a preferred embodiment, the device comprises a separate engine 19 for operation of the device 10, mounted to the rear of the work machine 15. One skilled in the art may appreciate that the means for translating the undercarriage 17 may also power the device 10 eliminating the need for the separate engine 19. Alternatively, the device 10 may be integrated into the work machine 15 or connected by other mechanisms known to one skilled in the art. The means for translating the undercarriage 17 comprises a powered motor (not shown) and may comprise powered tires, tracks, or a combination of tires and tracks. As shown, in FIG. 10, the work machine 15 comprises tires. The motor (not shown) may be hydraulic or electric and powered by a combustion engine, a hydraulic motor, an electric source or other power source. The tires or tracks may be powered by individual motors or a single motor. If tires are utilized, the work vehicle 15 may be steered through skid steering technique, or with turning wheels.

Turning again to FIG. 1, the device 10 comprises frame 20 and a rotatable cutting member 30, or drum, which is supported on the frame at both ends of the cutting member. A gear box 110 and motor 100 are located at one and/or both ends of the cutting member 30 and are covered by a protective panel 40 attached to an end plate 50. The surface of the cutting member 30 supports cutting blades or teeth (not shown) for removing obstructions or undesired materials as the drum rotates.

Figure 6:
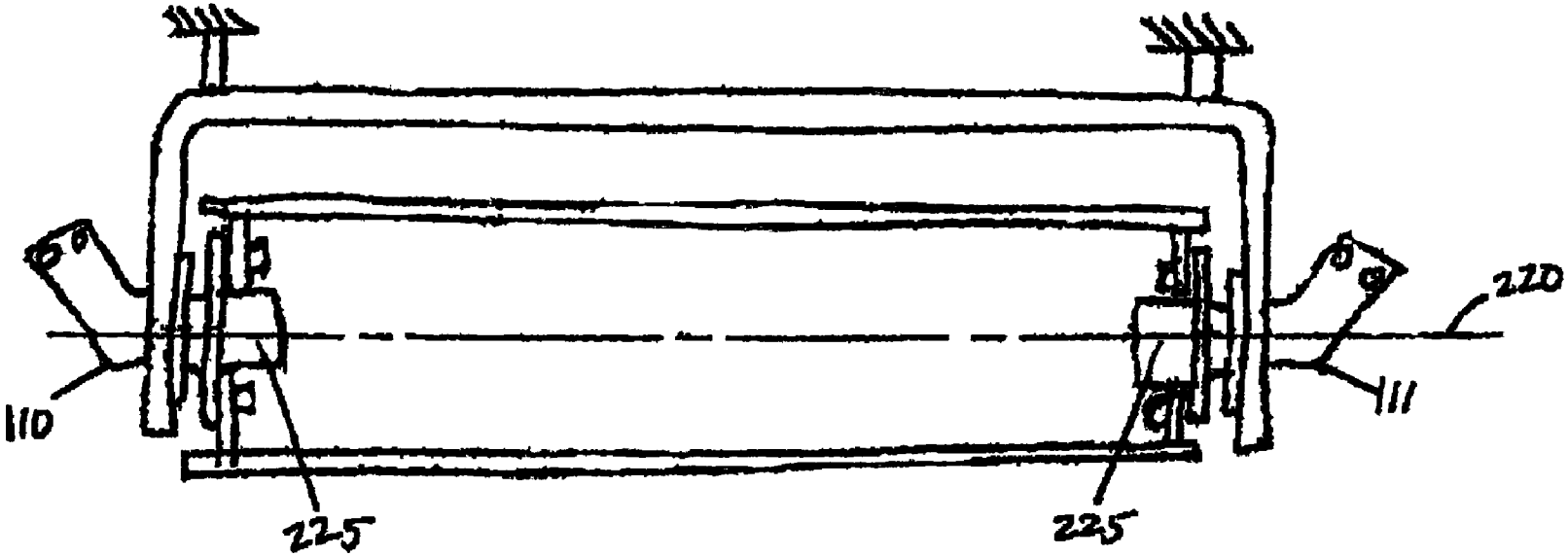
FIG. 6 is a longitudinal sectional view of the cutting assembly of FIG. 1.

The device 10 comprises a plurality of skid shoes 55 located on the frame 20. The skid shoes 55 provide a surface of contact between the ground and the device 10. Preferably, the skid shoes 55 may be adapted such that a distance between a centerline 220 (FIG. 6) of the cutting member 30 and the ground may be manipulated by an orientation of the skid shoes. More preferably, the orientation of the skid shoes 55 may be manipulated by the arms of the work vehicle or through other mechanical or hydraulic manipulation. Alternatively, the skid shoes 55 may be moveable relative to the cutting member through the use of hydraulic cylinder or mechanical means located on the frame 20. Further, a plurality of bolts could be disconnected and the skid shoes 55 repositioned to adjust the distance between the centerline 220 of the cutting member 30 and the ground.

Figure 2:
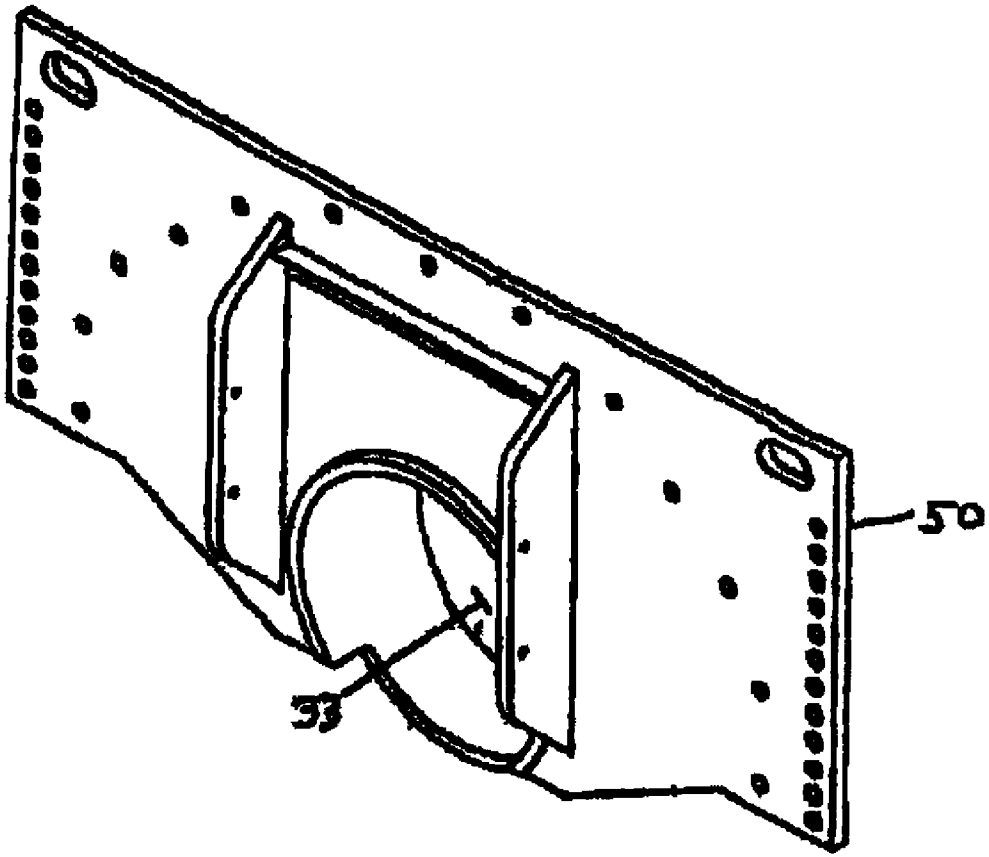
FIG. 2 is a perspective view of an end plate of the device shown in FIG. 1 with a protective panel removed to show the well into which the drum is inserted and supported.

Referring now to FIG. 2, the end plate 50 of the device 10 is shown with the protective panel 40 removed to expose the circular hole 33 in which cutting member 30 is supported.

Figure 3B:
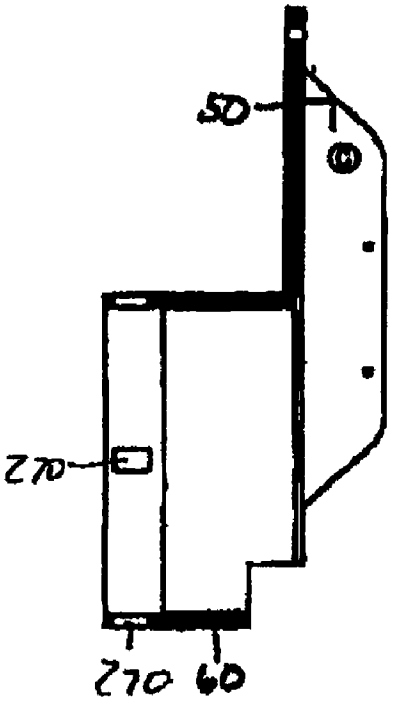
FIG. 3B is a sectional view taken from FIG. 3A showing of the support housing within which the drum is inserted and its relationship with the end plate.
Figure 3A:
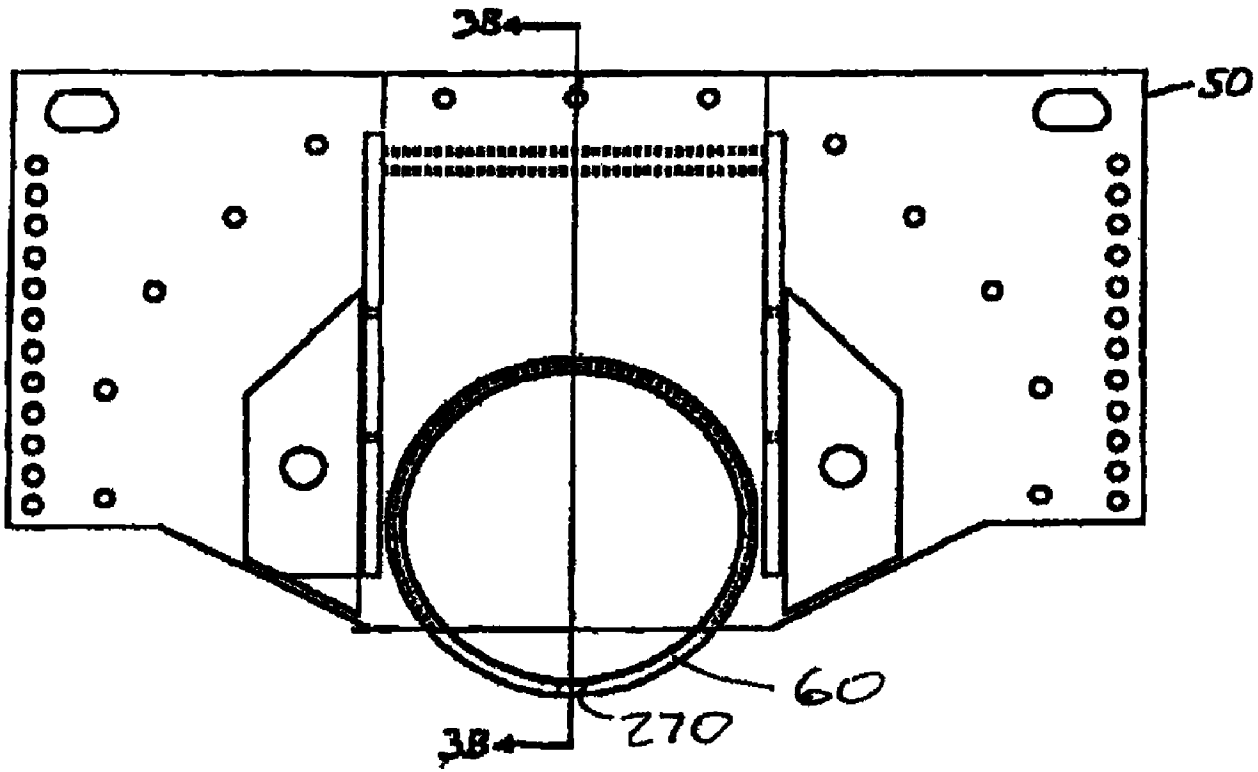
FIG. 3A is a plane view of an end plate for use with the present invention.
Figure 3C:
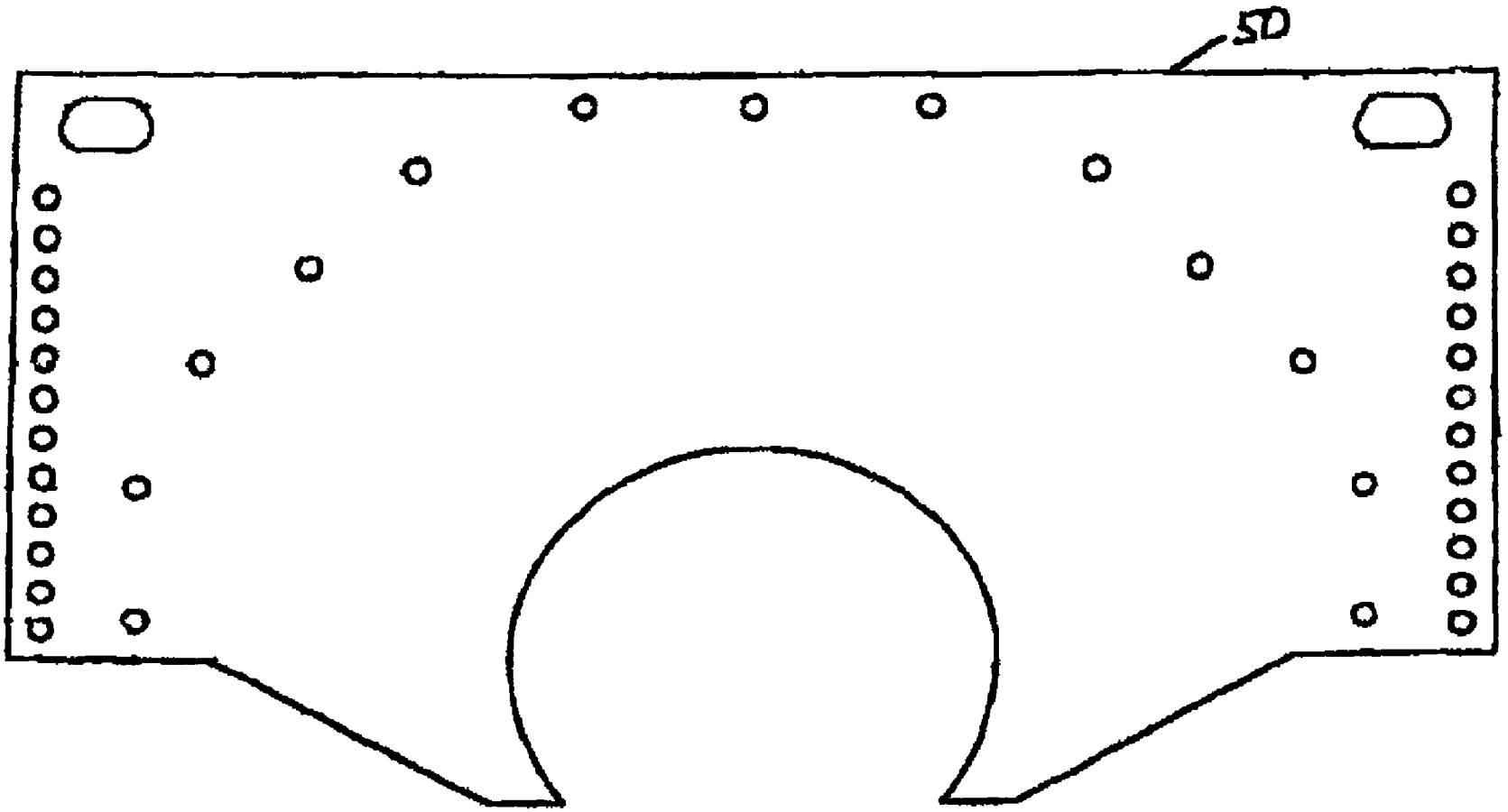
FIG. 3C shows the end panel with bolt holes.

Referring now to FIGS. 3A, 3B and 3C, the end plate 50 is shown and comprises a support housing 60 within which the cutting member 30 rotates and circular hole 33. The circular hole 33 is sized such that a flange 200 (FIG. 7) and motive force means 100 (FIG. 7) may be supported within the support housing 60. The support housing 60 defines a plurality of gaps 270 which will be described with more particularity below. Alternatively, the support housing may comprise a plurality of protrusions (not shown) which engage gaps in a flange as discussed in an alternative embodiment below. As shown in FIG. 3C, the end plate 50 may define a plurality of bolt holes 51 which provide connection points between the frame 20 and the skid shoes 55 as described in FIG. 1.

Figure 4B:
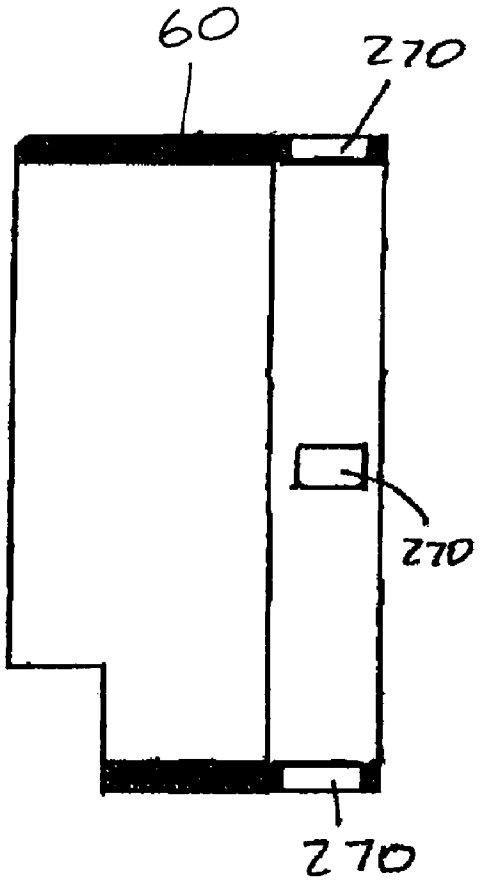
FIG. 4B is a sectional view of the support housing shown in FIG. 4A showing placement of the slots therein.
Figure 4A:
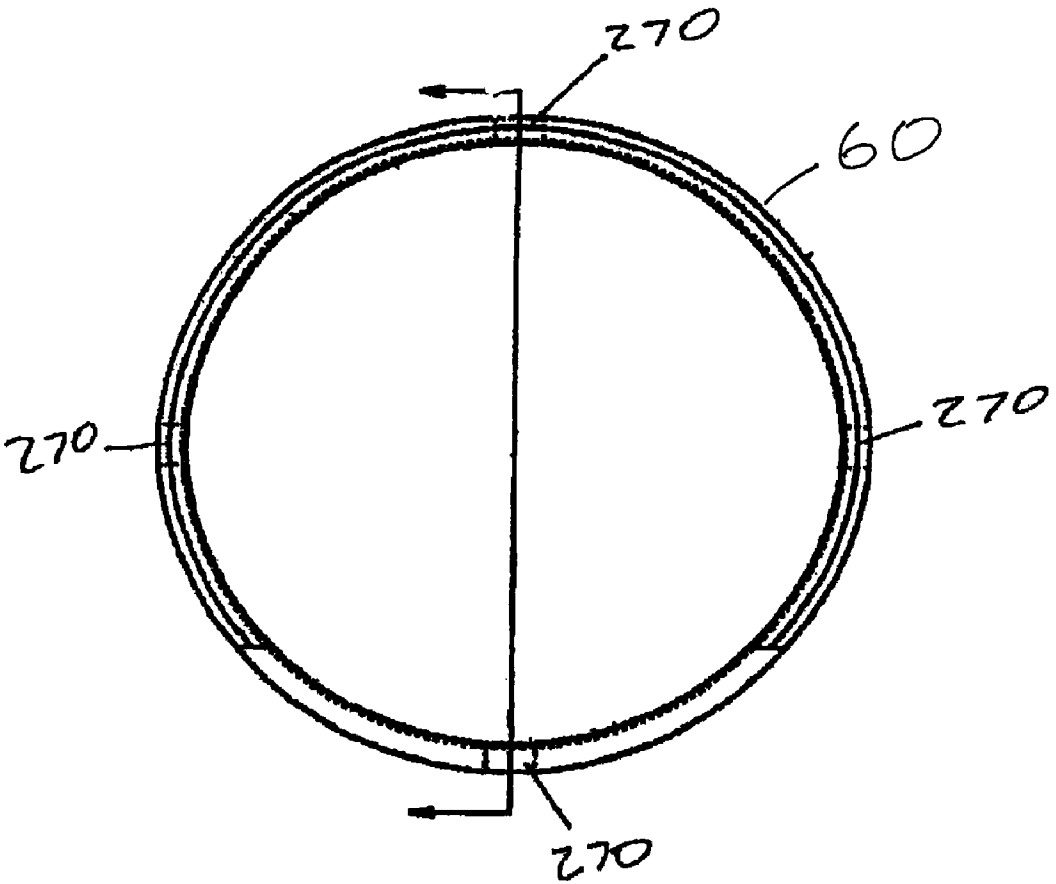
FIG. 4A is a plane view of the support housing shown previously in FIGS. 3A and 153B.

Referring now to FIGS. 4A and 4B, shown therein is the support housing 60. As shown, the support housing 60 comprises four (4) of the gaps 270 equally spaced about the support housing. Alternatively, a different number of gaps 270 or spacings thereof may be utilized, as long as those gaps correspond to the features of the flange as will be described below.

Figure 7:
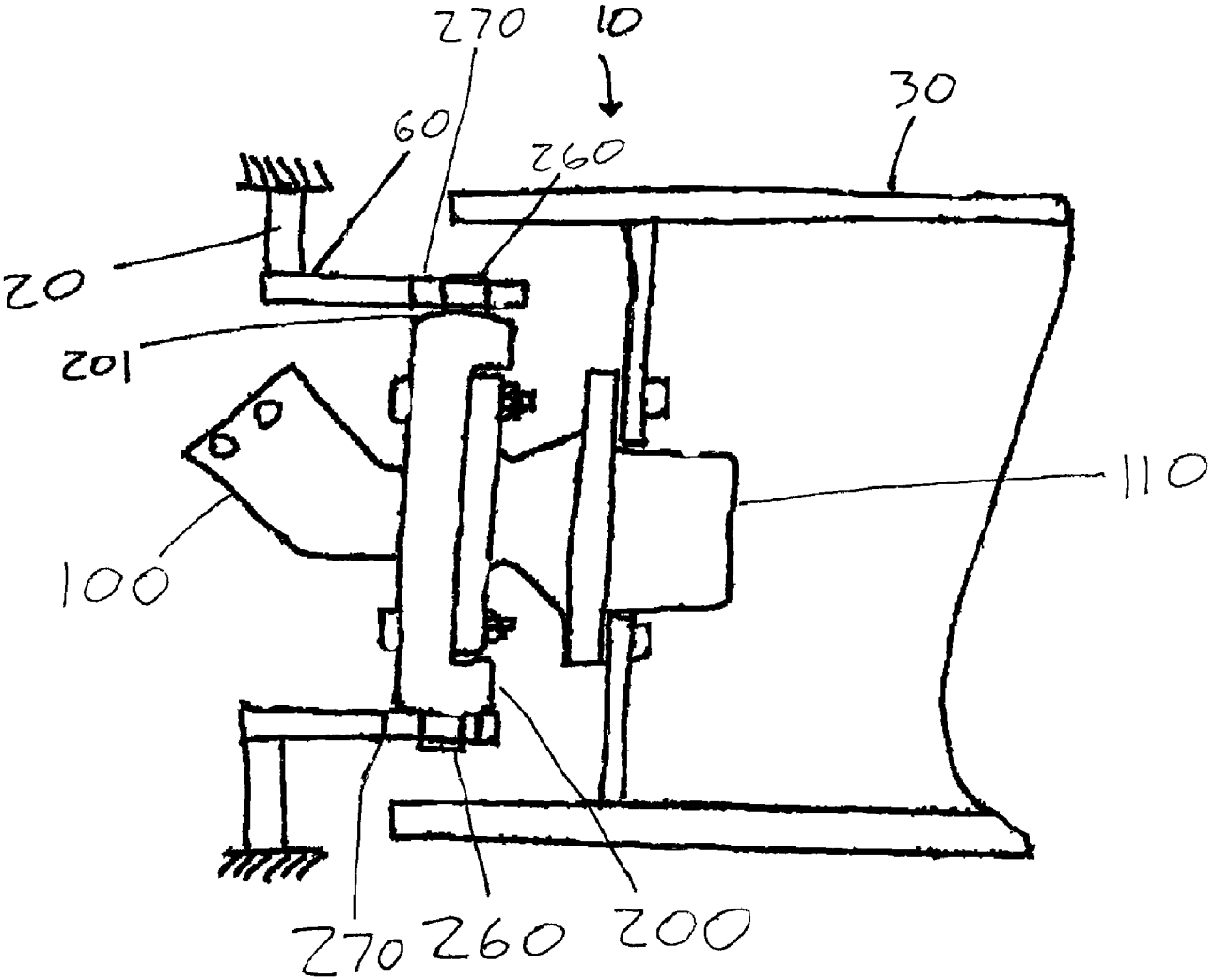
FIG. 7 is a cut-away sectional view of the components of a self-aligning flange for use with the cutting assembly of the present invention.
Figure 8B:
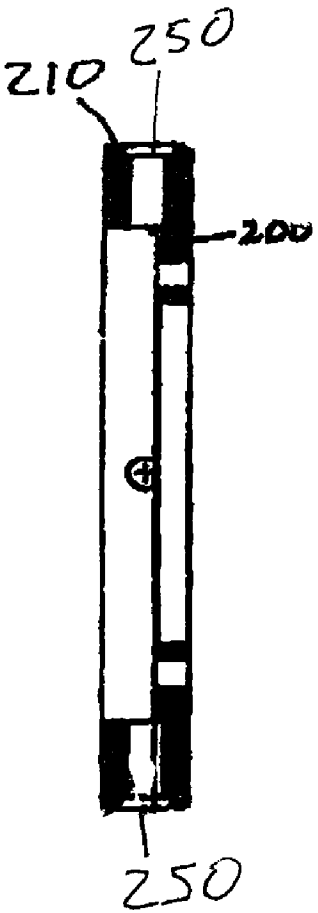
FIG. 8B is a side view of the self-aligning flange taken from FIG. 8A.
Figure 8A:
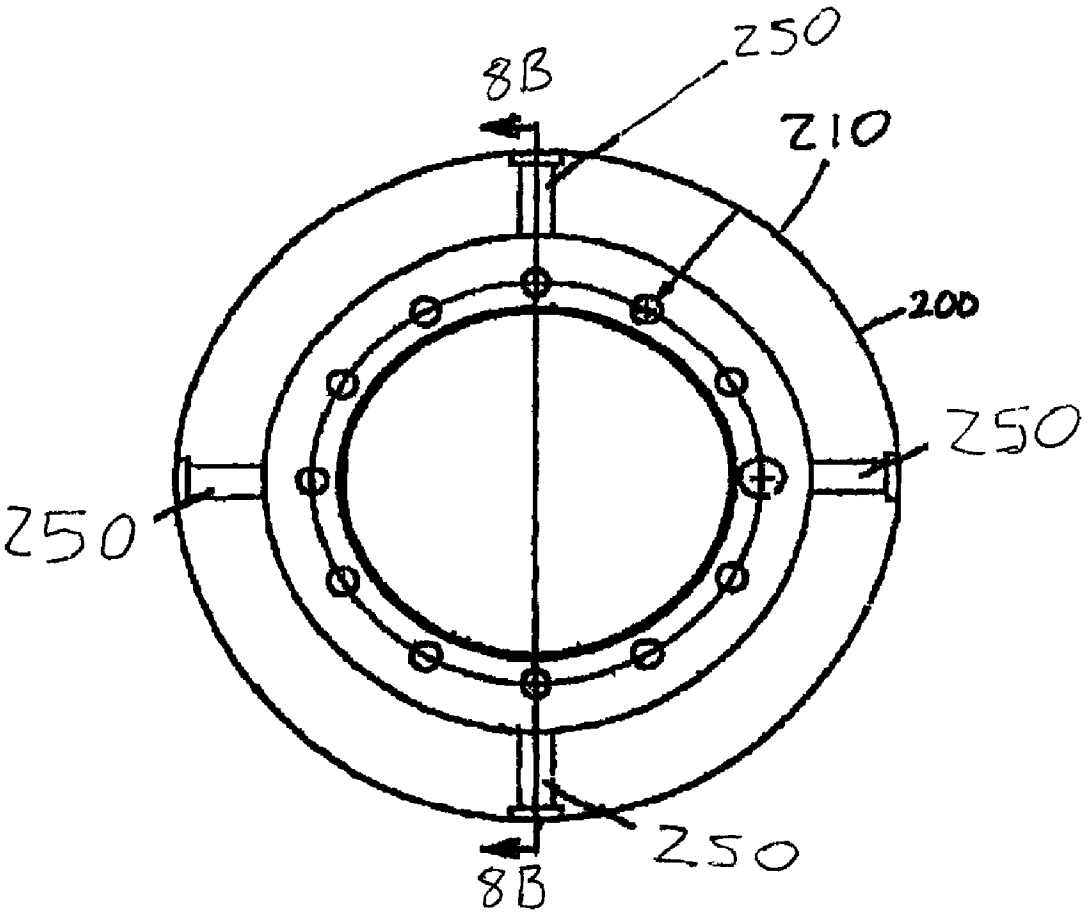
FIG. 8A is a side view of the self-aligning flange.

It should be noted that contact operation of the device 10 may cause the teeth to become deflected or broken. Deflected or broken teeth may call slight deviations in the weight of the cutting member 30. Even slight deviations in the weight of the cutting member 30 may cause it to become slightly unbalanced. Additionally, extreme cold weather may cause internal components of the cutting member 30 to expand due to heat caused by rotation of the cutting member, while the frame may contract due to external temperatures. As shown in FIG. 7, a self-aligning flange 200 is introduced to solve these and other problems.

Turning now to FIG. 7, a sectional view of the device 10 is shown. The device 10 comprises the frame 20, the cutting member 30, a means for rotating the cutting member 60, and a means for aligning the centerline 220 of the cutting member 30 while allowing movement of the cutting member along at least one length.

The frame 20 provides support for other elements of the device 10 and comprises the support member 60 as described above. The support member 60 is constrained to contain the means for aligning the centerline 220. This means, as shown in FIG. 7, comprises a self-aligning flange 200. The flange 200 is non-rotatably supported within the support member 60 by radially extending retaining members or protrusions 260 adapted to mate with the gaps 270 in the support housing 60. The flange 200 may comprise a rim 201 that is a sectional ellipsoid or sphere. The protrusions 260 are sized within the gaps 270 such that the flange 200 is moveable about three axes relative to the support housing 60, limited only by the tolerance of the gaps 270 relative to the protrusions 260. The protrusions 260 are sufficiently sized such that rotational forces due to operation of the first motive force means 100 and the rotational cutting member 30 are fully transferred to the frame 20, while allowing the flange 200 some tolerance of motion about at least one axis. Preferably, some tolerance of motion is allowed about at least three axes.

The means for rotating the cutting member 30 comprises a motive force means 100. The motive force means 100 may comprise a motor and gear box 110. Alternatively, the motive force means comprises hydraulic or other components adapted to provide a rotational force to the cutting member 30. The motive force means 100 may be powered by a dedicated combustion engine or power may be provided externally from components of the work machine. The motive force means 100 provides power which is transferred to rotational motion by the gear box 110. As shown, the motive force means 100 is suspended within the support housing and the gear box is attached to an inner surface of the rotating cutting member 30 at an internal drum 31. Alternatively, a belt or chain system may be utilized to provide rotational motion to the rotating cutting member 30.

Figure 5:
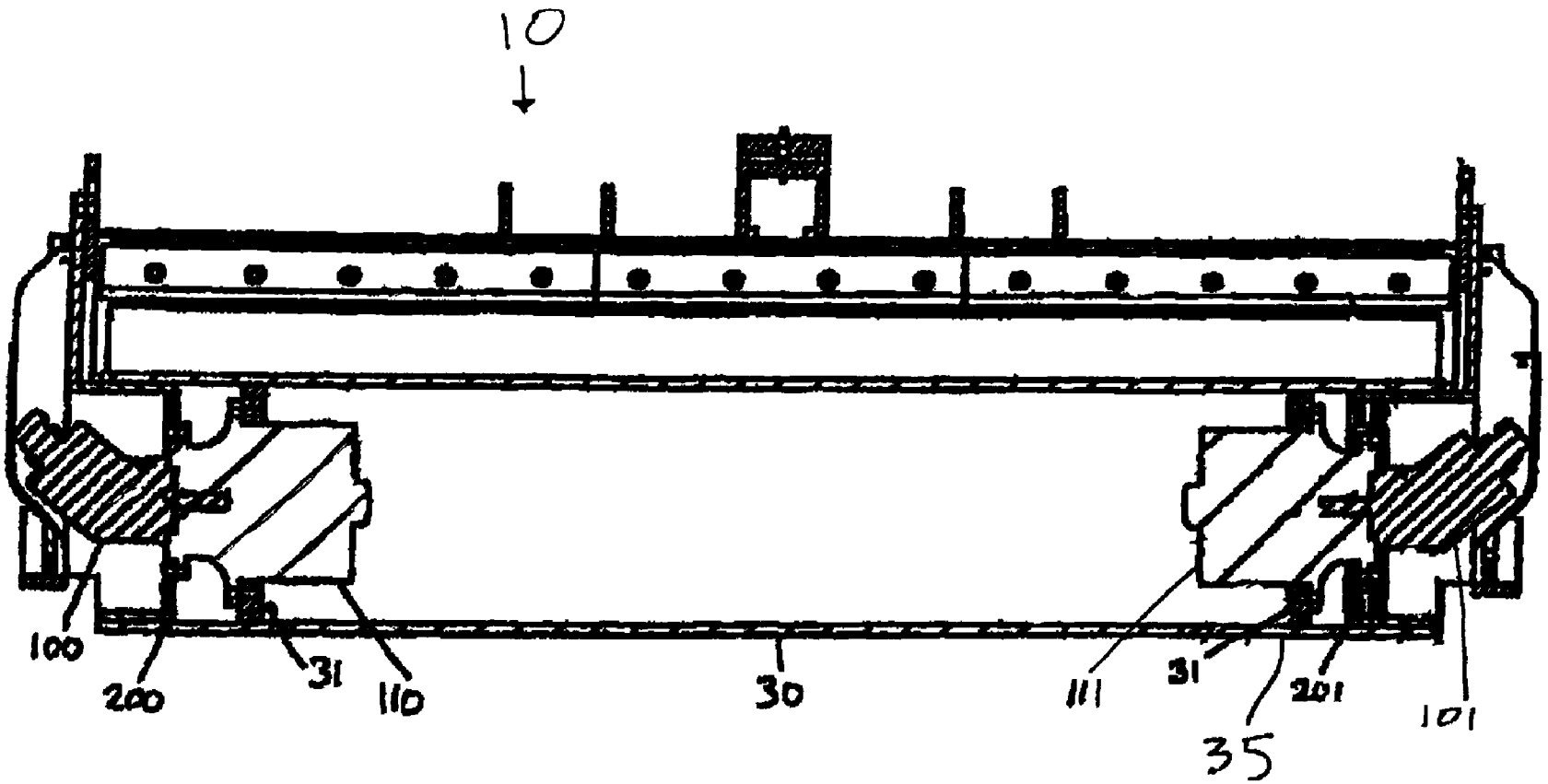
FIG. 5 is a longitudinal sectional view of the cutting assembly of FIG. 1.

Turning now to FIG. 5, a cross-section of the device 10 is shown. As shown, the device 10 further comprises a second flange 201, a second motive force means 101 comprising a second gear box 111 at a second end 35 of the cutting member 30. The flange 200 and second flange 201 may be substantially identical at each end of the cutting member 30. At each end of the cutting member 30 the gear box 110 and second gear box 111 are fixedly bolted to an internal drum 31 within each end of cutting member 30 so that the centerline 225 (FIG. 6) of each gear box 110, 111 is substantially aligned with the centerline 220 (FIG. 6) of the rotating cutting member.

One skilled in the art will appreciate the device 10 may comprise only one motive force means 100 at a first end of the cutting member 30. In this embodiment, the second flange 201 located at a second end 35 of the cutting member 30 would comprise a bearing such that the second end of the cutting member would rotate freely relative to the second flange, while allowing the second flange to move about a plurality of axes relative to the support housing 60 as discussed above with reference to FIG. 7.

The first motive force means 100 is adapted to operate with sufficient horsepower to rotate the cutting member 30 at an operational rate. For example, the motive force means may provide an operational rate of thirty-five horsepower in an application utilizing light equipment. Alternatively, heavy-duty applications of the present invention may require an operational rate of five hundred forty horsepower. The gear box 110 is adapted to rotate the cutting member 30 at a rotational velocity between 10 and 1500 rpm. Preferably, the cutting member 30 has a rotational velocity between 300 and 800 rpm. The preferred rotational velocity of the cutting member 30 provided by the motive force means 100, 101 for clearing brush and trees is 500 rpm. However, other speeds may be advantageous for other applications of the device 10, such as the breaking of rock or permafrost, and thus other speeds of the cuffing member 30 are anticipated.

With reference to FIGS. 5A and 3B, shown therein is a cross section of the flange 200. As shown, the flange 200 comprises a number of axial bolt holes 250. Each of the to projections 260 are inserted into the holes 250 such that they extend beyond the rim 210 of the flange 200 and engage the support housing 60 at gaps 270 (FIG. 7). Alternatively, projections from the support housing 60 may extend into the bolt holes 250.

Figure 9:
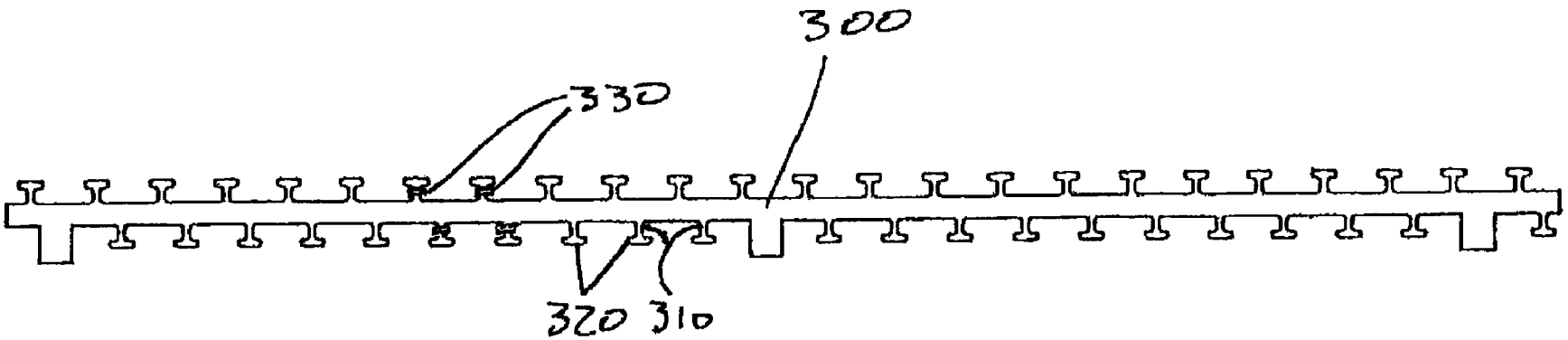
FIG. 9 is a top view of an elongate member comprising a plurality of lateral shafts.

Turning now to FIG. 9, shown therein is a debris blocking device supportable on the frame 20 and adapted to decrease the range of travel of debris generated during operation of the cutting member 30. The debris blocking device comprises an elongate member 300 comprising a plurality of lateral shafts 310, each lateral shaft 310 terminating in a knob 320. The elongate member 300 is adapted to be fixed to the work vehicle with a substantially horizontal orientation. The knob 320 is defined by a width that is substantially greater than its corresponding lateral shaft 310. Each lateral shaft is adapted to support a means for settling debris, or debris blocking member 330. As shown in FIG. 9, the blocking members 330 may comprise a length of chain hanging from each lateral shaft 310. Each of the chains 330 may be looped over one of the plurality of knobs 320 and suspended from one of the plurality of lateral shafts 310. The lateral shafts 310 are preferably positioned such that each chain 330 is suspended freely and extends substantially from the elongate member 300 to the ground. The looping, instead of bolting or welding, of the chains 330 to the lateral shafts 310 allows cheap, efficient replacement when one or more of the plurality of chains is broken or lost during operation of the device 10.

The plurality of blocking members 330 are positioned such that they provide a means for knocking down spoils, or brush that has been displaced by the operation of the cutting member 30. The plurality of blocking members 30 may be positioned proximate the device 10, or at any other location on the work vehicle where the settling of spoils is desired. Preferably, the elongate member 300 is positioned to the rear of the cutting member 30 and attached to the frame 20 (shown in FIG. 1 without the chains 330). Alternatively, the blocking members 330 may comprise iron rods, polymer or metal flaps, or other instruments to settle spoils. The blocking members 330 may be placed on one or both sides of the elongate member 300.

As has been demonstrated, the present invention provides an advantageous apparatus and method for maintaining alignment and balance of a massive rotating cylindrical drum within close tolerances. While the preferred embodiments of the present invention have been described, additional variations and modifications in those embodiments may occur to those skilled in the art once they learn of the basic inventive concepts. Therefore, it is intended that the appended claims shall be construed to include both the preferred embodiment and all such variations and modifications as fall within the spirit and scope of the invention.

What is claimed is:

1. A device for removing obstructions from a work site comprising:

a frame;

a flange supported on the frame and independently moveable relative to the frame about three axes;

a first motive force means supported by the flange; and a rotatable cutting member operatively connected to the motive force means such that the motive force means is disposed within the rotatable cutting member.

2. The device of claim 1 further comprising;

an elongate member supported on the frame, the elongate member comprising a plurality of lateral shafts, each terminating in a knob; and a plurality of blocking members, each adapted to be removable from each lateral shaft, wherein one of the plurality of blocking members is suspended from one of the plurality of lateral shafts.

3. The device of claim 2 wherein each of the plurality of blocking members comprises a chain.

4. The device of claim 1 wherein the first motive force means is adapted to provide 500 horsepower.

5. The device of claim 1 wherein the first motive force means is adapted to rotate the rotatable cutting drum within the range of 300 to 800 rpm.

6. The device of claim 1 further comprising a second flange located at a second end of the rotatable cutting member, and a second motive force means supported by the second flange.

7. The device of claim 6 further comprising a single power source, wherein the single power source is adapted to provide power to both of the first motive force means and second motive force means.

8. The device of claim 1 wherein the first motive force means comprises a hydraulic motor adapted to drive rotation of the rotatable cutting members.

9. The device of claim 1 wherein the rotatable cutting member comprises a cylindrical member comprising a first end, a second end, an outer surface, and a plurality of cutting members supported on the outer surface of the cylindrical member, wherein the first motive force is disposed at the first end of the cylindrical member.

10. The device of claim 9 further comprising a second motive force means supported within the cylindrical member at the second end.

11. The device of claim 10 wherein the first and second motive force means operate in coordination to rotate the rotatable cutting member.

12. The device of claim 1 wherein the flange comprises a plurality of radially extending retaining members adapted to engage the frame during operation of the first motive force means.

13. The device of claim 2 wherein the blocking members are supported by the elongate member rearward of the rotatable cutting member.

14. A device for removing obstructions from a work site comprising:

a frame;

a cutting drum;

a means for rotating the cutting drum supported by the frame; and a means for mounting the cutting drum to the frame and for allowing independent movement of the cutting drum about three axes relative to the frame;

wherein the means for mounting the cutting drum is supported by the means for rotating the cutting drum.

15. The device of claim 14 further comprising a means for settling spoils created by the cutting drum.

16. The device of claim 14 wherein the means for rotating the cutting drum is adapted to rotate the cutting drum at a speed between 300 and 800 rpm.

17. A work machine comprising:

an undercarriage;

a means for translating the undercarriage; and a device for removing obstructions from a work site connected to the undercarriage, the device comprising:

a frame;

a flange supported on the frame and independently moveable about three axes relative to the frame and undercarriage;

a first motive force means supported by the flange; and a cutting member operatively connected to the first motive force means such that the first motive force means is disposed within the cutting member.

18. The work machine of claim 17 wherein the cutting member comprises a first end, a second end, and a longitudinal centerline, the machine further comprising a first skid shoe disposed at the first end of the cutting member and a second skid shoe disposed at the second end of the cutting member.

19. The work machine of claim 18 wherein the first skid shoe and the second skid shoe are both operably connected to the frame such that a distance between the longitudinal centerline of the cutting member and the ground is manipulated by operation of the first skid shoe and the second skid shoe.

20. The work machine of claim 17 wherein the cutting member comprises a longitudinal centerline, and wherein the first motive means comprises a rotational centerline, wherein the flange is adapted to substantially align the centerline of the first motive force means with the centerline of the cutting member.

21. The work machine of claim 17 further comprising:

an elongate member connected to the frame comprising a plurality of lateral shafts, each lateral shaft terminating in a knob; and a plurality of chains, each adapted to be removable from each lateral shaft, wherein each of the chains is suspended from each of the plurality of lateral shafts.

22. The device of claim 17 further comprising a single power source and a second motive force means disposed within the cutting member, wherein the single power source is adapted to provide power to both of the first motive force means and the second motive force means.

23. A device comprising:

a frame; and a drum assembly comprising:

a flange supported on the frame and independently movable about three axes relative to the frame;

a first motive force means supported by the flange; and a rotatable drum operatively connected to the first motive force means such that the first motive force means is disposed within the rotatable drum.

24. The device of claim 23 further comprising at least one blade supported on the rotatable drum.

25. The device of claim 24 wherein the at least one blade is adapted to remove snow or ice.

26. The device of claim 23 further comprising a cutting member operatively supported on the rotatable drum.

* * * * *

UNITED STATES PATENT AND TRADEMARK OFFICE

CERTIFICATE OF CORRECTION

PATENT NO. : 8,176,990 B2
APPLICATION NO. : 12/113542
DATED : May 15, 2012
INVENTOR(S) : Beller et al.

It is certified that error appears in the above-identified patent and that said Letters Patent is hereby corrected as shown below:

Column 3, line 13 please delete "153B" and substitute therefore --3B--.
Column 6, line 5 please delete "5A" and substitute therefore --8A--.
Column 6, line 5 please delete "3B" and substitute therefore --8B--.
Column 6, line 7 please delete the word "to".

Signed and Sealed this
Tenth Day of July, 2012

David J. Kappos

David J. Kappos
*Director of the United States Patent and Trademark Office*